US009516980B2

(12) United States Patent
Kim

(10) Patent No.: US 9,516,980 B2
(45) Date of Patent: Dec. 13, 2016

(54) VACUUM CLEANER

(71) Applicant: HOUSSEN Co., Ltd., Gyeonggi-do (KR)

(72) Inventor: Byung Mi Kim, Incheon (CN)

(73) Assignee: HOUSSEN CO., LTD., Siheung-shi, Gyeonggi-do (KR)

( * ) Notice: Subject to any disclaimer, the term of this patent is extended or adjusted under 35 U.S.C. 154(b) by 0 days.

(21) Appl. No.: 14/779,509

(22) PCT Filed: Apr. 17, 2014

(86) PCT No.: PCT/KR2014/003333
§ 371 (c)(1),
(2) Date: Sep. 23, 2015

(87) PCT Pub. No.: WO2014/171750
PCT Pub. Date: Oct. 23, 2014

(65) Prior Publication Data

US 2016/0051102 A1 Feb. 25, 2016

(30) Foreign Application Priority Data

Apr. 19, 2013 (KR) ..... 10-2013-0043701

(51) Int. Cl.
*A47L 5/14* (2006.01)
*A47L 5/26* (2006.01)
(Continued)

(52) U.S. Cl.
CPC .. *A47L 5/26* (2013.01); *A47L 5/14* (2013.01); *A47L 5/28* (2013.01); *A47L 7/04* (2013.01);
(Continued)

(58) Field of Classification Search
CPC ..... A47L 5/14; A47L 5/26; A47L 5/28; A47L 7/04; A47L 9/02; A47L 9/08; A47L 9/12; A47L 11/405
(Continued)

(56) References Cited

U.S. PATENT DOCUMENTS 7,836,548 B2 11/2010 Cho
2008/0052872 A1 3/2008 Cho

FOREIGN PATENT DOCUMENTS

JP 2003-079542 A 3/2003
KR 10-1154822 B2 6/2012
WO 2013/002599 A2 1/2013

OTHER PUBLICATIONS

International Search Report in corresponding PCT application PCT/KR2014/00333 dated Aug. 18, 2014, 2 pp. In English and 2 pp. in Korean.

*Primary Examiner* — David Redding
(74) *Attorney, Agent, or Firm* — Juan Carlos A. Marquez; Marquez IP Law Office, PLLC

(57) ABSTRACT

A vacuum cleaner blows hot air to dry objects to be cleaned and prevent adhesion of the objects. The vacuum cleaner includes a first bottom air inlet, a rear air outlet, a housing having an air passage for guiding first air from the first bottom air inlet to the rear air outlet, and an electric blower fan in the air passage to suck up the first air. The housing includes a headwind inlet that inhales second air from outside and guides its flow as a headwind against the flow of the first air preventing adhesion of objects to be cleaned. A bottom air outlet discharges hot air heated when passing by the electric blower fan. A flow direction changer changes the direction of the hot air to the rear and/or bottom air outlets. A user selectively controls the flow direction of the hot air toward the objects to be cleaned, thereby drying them. A
(Continued)

headwind blows against the flow of air inhaled into the housing and prevents adhesion of the objects to be cleaned, thereby improving usability.

10 Claims, 17 Drawing Sheets

(51) Int. Cl.

| | |
|---|---|
| ***A47L 5/28*** | (2006.01) |
| ***A47L 9/02*** | (2006.01) |
| ***A47L 7/04*** | (2006.01) |
| ***A47L 9/08*** | (2006.01) |
| ***A47L 9/12*** | (2006.01) |
| *A47L 11/40* | (2006.01) |

(52) U.S. Cl.
CPC .. *A47L 9/02* (2013.01); *A47L 9/08* (2013.01); *A47L 9/12* (2013.01); *A47L 11/405* (2013.01)

(58) Field of Classification Search
USPC ..... 15/345
See application file for complete search history.

VACUUM CLEANER

CROSS-REFERENCE TO RELATED APPLICATIONS

This application claims the benefit of PCT application PCT/KR2014/003333, filed on Apr. 17, 2014, which claims the benefit of Korean patent application 10-2013-0043701 filed on Apr. 19, 2013. The entire content of each of the above-identified applications is incorporated herein by reference.

TECHNICAL FIELD

The present invention relates to a vacuum cleaner, and more particularly to a vacuum cleaner which can blow hot air to dry objects to be cleaned so as to prevent adhesion of the objects to be cleaned.

BACKGROUND ART

A vacuum cleaner is a device that drives a built-in electric blower fan provided in a housing to create a suction force, uses the suction force to suck up air containing dust or the like foreign materials into the housing, and filters and discharges the sucked air to the outside of the housing through a filter. Such a vacuum cleaner is classified into a canister type, an upright type and a handy type.

U.S. Pat. No. 7,836,548 discloses a "vacuum cleaner" that includes a housing, an electric blower fan, a first filter unit and a second filter unit. The housing includes an air inlet formed in a front bottom of the housing to inhale air, an air outlet formed in a rear outer surface of the housing to discharge air, and an air passage formed to guide air flow between the air inlet and the air outlet. The electric blower fan is placed in the air passage, and includes an electric motor and a fan that is rotated by the electric motor to create a force for sucking up air.

When the electric motor is driven to rotate the fan, air is inhaled through the air inlet and then discharged through the air outlet via the air passage. The first filter unit is arranged in front of the electric blower fan, and filters and collects foreign materials in air. The second filter unit is provided in the rear outer surface of the housing and covers the air outlet, thereby filtering foreign materials in air discharged through the air outlet.

DISCLOSURE

Technical Problem

In a conventional vacuum cleaner as described above, air is heated to have a temperature of 40~60° C. with heat of the electric blower fan while passing by the electric blower fan and is then discharged to the rear of the housing. Thus, the conventional vacuum cleaner has problems causing difficulties and is inconvenient for a user since s/he is exposed to hot air. The problems due to the discharge of the hot air are aggravated in a handy-type vacuum cleaner, and thus a user evades the use of the vacuum cleaner. By the way, a vacuum cleaner used in cleaning bedclothes has been required to have a function of preventing the bedclothes from being adsorbed to the air inlet and a function of drying the bedclothes. However, the vacuum cleaner satisfying this requirement has not been developed yet.

The present invention has been conceived to solve the foregoing problems of the conventional vacuum cleaner, and an aspect of the present invention is to provide a vacuum cleaner, in which a flowing direction of hot air heated by heat of an electric blower fan is selectively controlled to blow the hot air to objects to be cleaned, thereby drying the objects to be cleaned and minimizing exposure of a user to the hot air.

Another aspect of the present invention is to provide a vacuum cleaner, in which air inhaled into a housing meets a headwind, thereby preventing adhesion of the objects to be cleaned.

Still another aspect of the present invention is to a vacuum cleaner, in which air introduced into a dust box is filtered forming swirl flow, thereby preventing a filter from clogging.

Technical Solution

In accordance with an embodiment of the present invention, there is provided a vacuum cleaner. The vacuum cleaner according to the present invention includes a first bottom air inlet, a rear air outlet, a housing having an air passage for guiding first air to flow from the first bottom air inlet to the rear air outlet, and an electric blower fan mounted in the air passage and generating a force for sucking up the first air. Further, the housing includes a headwind inlet that inhales second air from an exterior and guides flow of the inhaled second air as a headwind against the flow of the first air so as to prevent adhesion of objects to be cleaned, and a bottom air outlet formed on a bottom surface of the housing to discharge hot air heated by heat of the electric blower fan while passing by the electric blower fan, and a flow direction changer is mounted in the housing and changes a flow direction of the hot air to the rear air outlet and/or the bottom air outlet.

In addition, the flow direction changer includes a first branched passage formed inside the housing and connecting the air passage and the rear air outlet; a second branched passage formed inside the housing and connecting the air passage and the bottom air outlet; and a baffle plate mounted in the housing to open and close the first branched passage and/or the second branched passage, or rotatably mounted in the housing to open and close the bottom air outlet.

Advantageous Effects

In a vacuum cleaner according to the present invention, a flowing direction of hot air heated by heat of an electric blower fan is selectively controlled by a user so that the hot air can flow to the bottom air outlet and/or the rear air outlet and be blown to objects to be cleaned, thereby drying the objects to be cleaned and minimizing exposure of a user to the hot air. Further, air inhaled into a housing meets a headwind to prevent adhesion of the objects to be cleaned, thereby improving usability. In addition, air introduced into a dust box is filtered forming swirl flow to prevent a filter from clogging, thereby improving reliability. Accordingly, the vacuum cleaner according to the present invention is convenient and easy to clean flexible objects to be cleaned such as bedclothes.

BEST MODE

Figure 1:
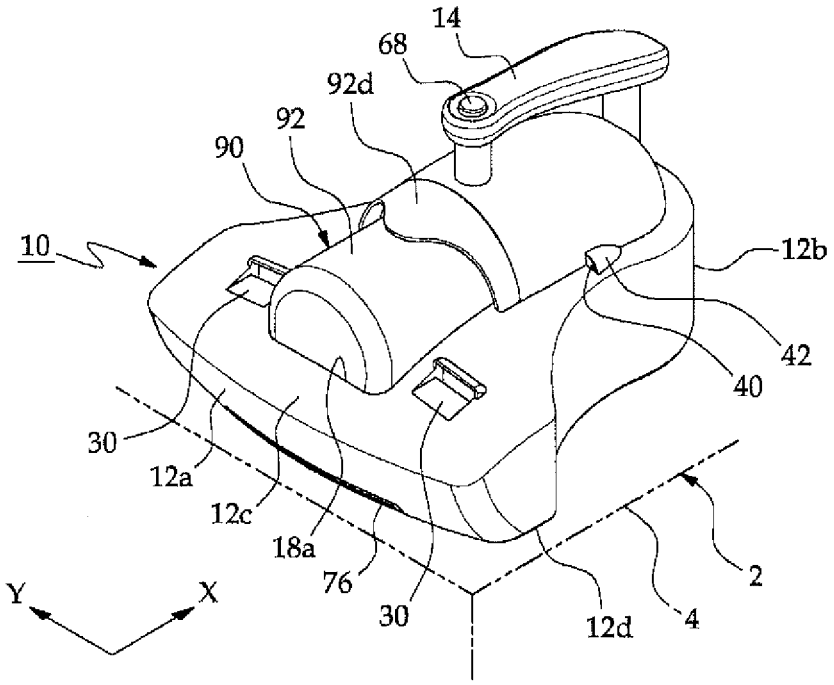
FIG. 1 is a perspective view of a vacuum cleaner according to the present invention.

Other objects, certain advantages and new features of the present invention will be apparent from accompanying drawings, the following detailed description and exemplary embodiments.

Below, exemplary embodiments of a vacuum cleaner according to the present invention will be described with reference to accompanying drawings.

First, referring to FIGS. 1 to 8, a vacuum cleaner according to the present invention includes a housing 10 forming an outer appearance. The housing 10 has a front surface 12*a*, a back surface 12*b*, a top surface 12*c*, a bottom surface 12*d*, a lengthwise direction X and a widthwise direction Y perpendicular to the lengthwise direction X. The bottom surface 12*d* of the housing 10 contacts objects to be cleaned 2, for example, surfaces of bedclothes 4 so as to clean the objects to be cleaned 2. To enlarge a contact area between the bottom surface 12*d* and the objects to be cleaned 2, a front side of the housing 10 is wider than a back side. The top surface 12*c* is provided with a grip 14 to be gripped by a user's hand. The back surface 12*b* is formed with a slot 16 at a lower side thereof along the widthwise direction Y.

Figure 3:
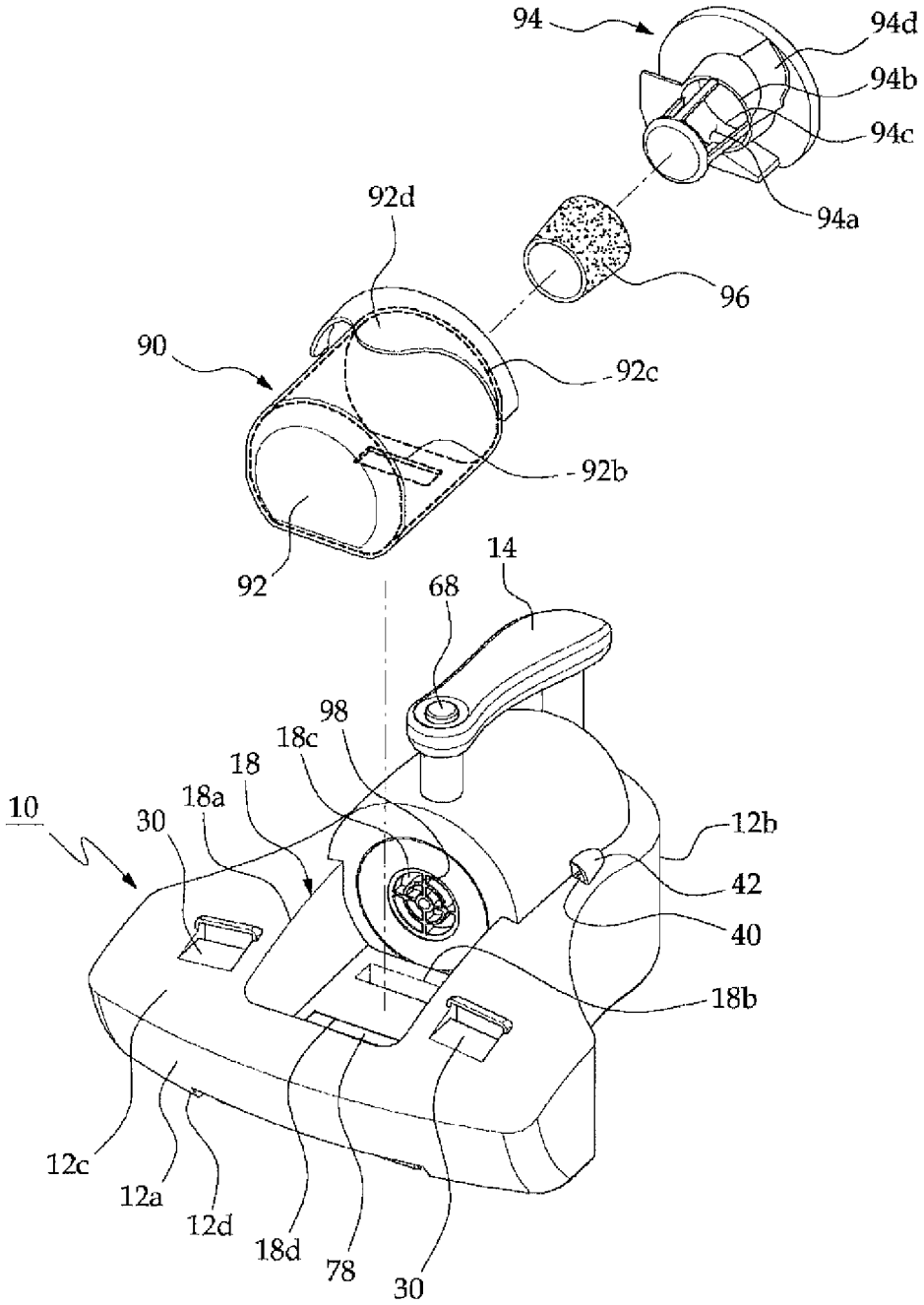
FIG. 3 is an exploded perspective view of a first filter unit in the vacuum cleaner according to the present invention.
Figure 7:
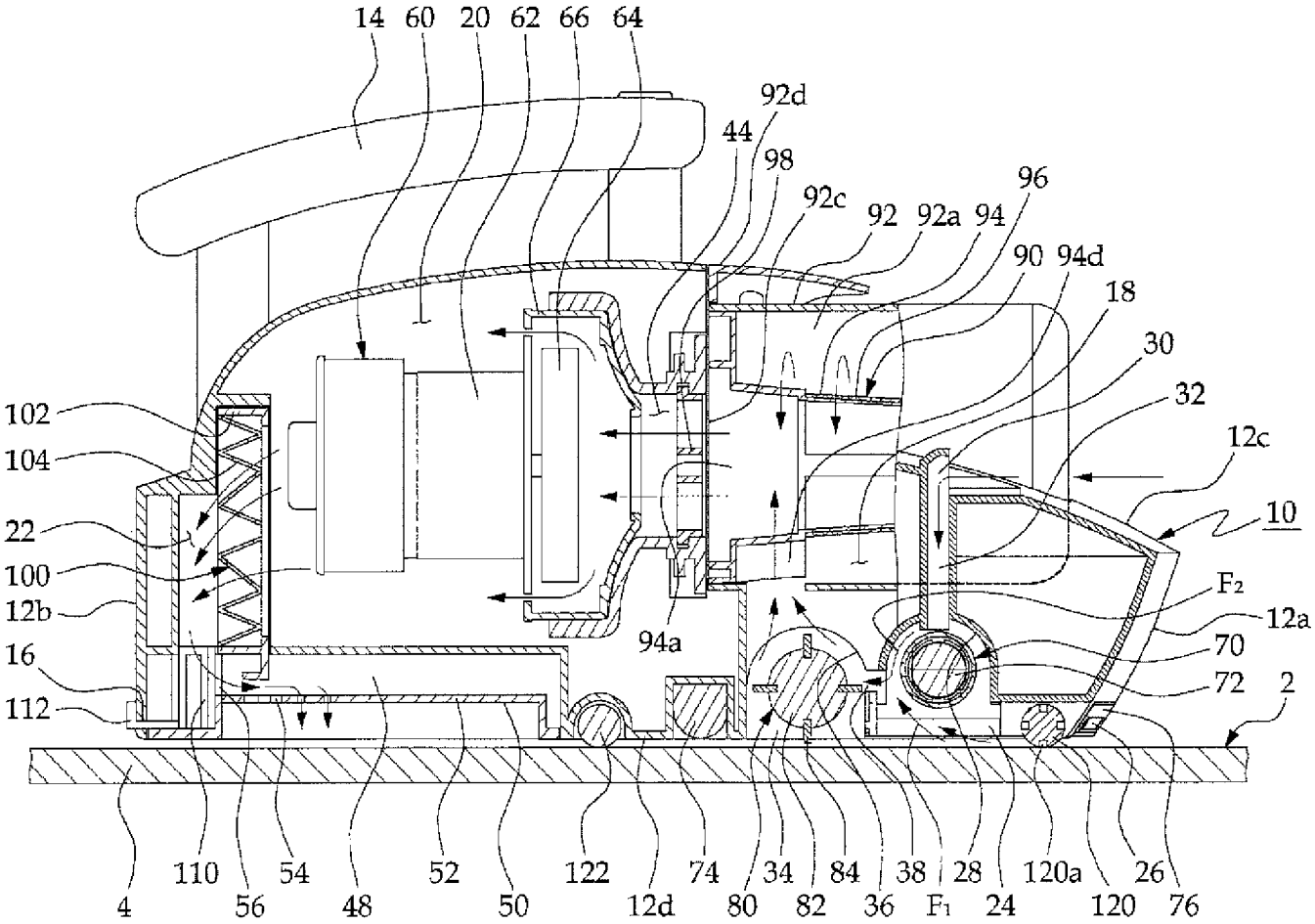
FIG. 7 is a cross-section view of the vacuum cleaner according to the present invention.
Figure 8:
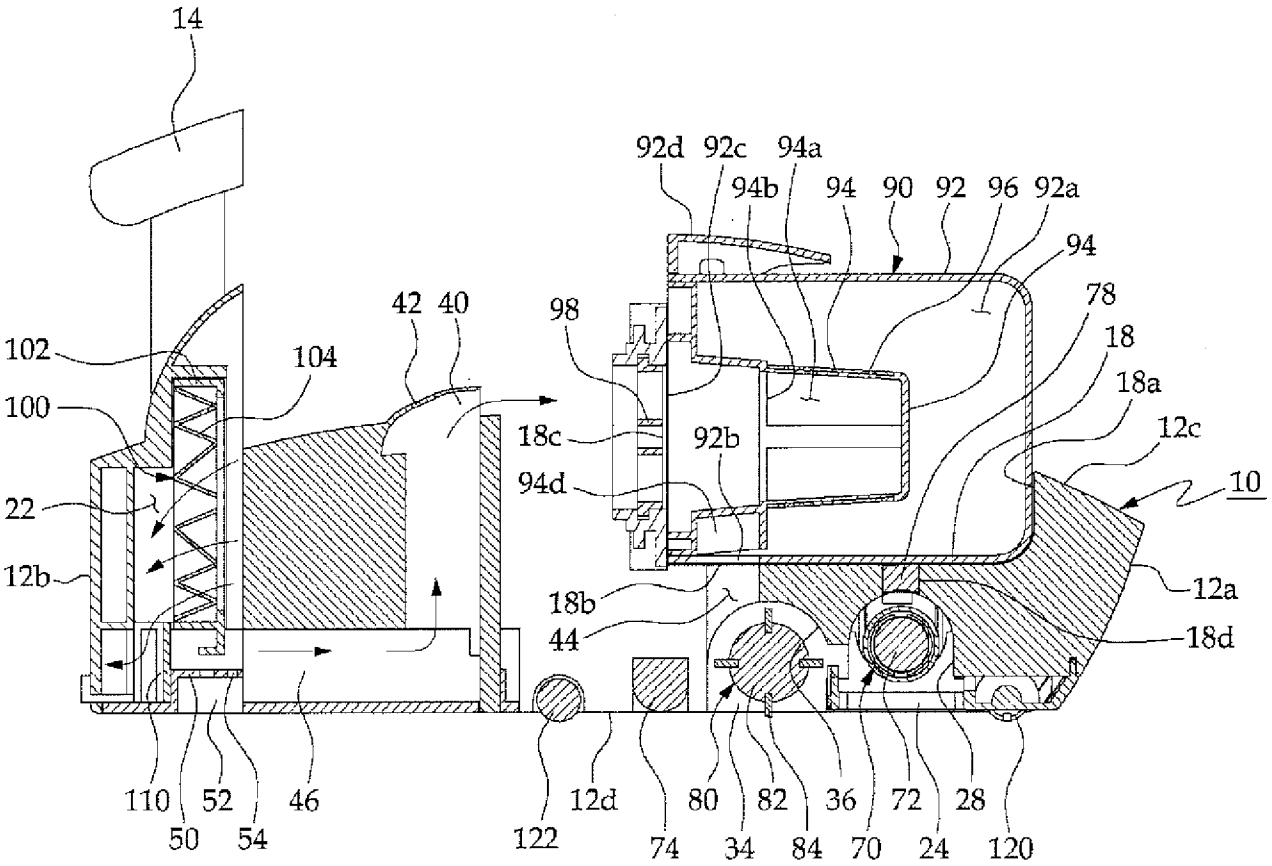
FIG. 8 is a cross-section view of a first branched passage and a rear air outlet in the vacuum cleaner according to the present invention.

As shown in FIGS. 3, 7 and 8, an accommodating position 18 is recessed in an outer front side of the housing 10. An open end 18*a* is formed above the accommodating portion 18. An air inlet 18*b* for inhaling air is formed in a back portion of a bottom surface of the accommodating portion 18. An air outlet 18*c* for discharging air is formed on a back wall of the accommodating portion 18. A hole 18*d* is formed in a front portion of the bottom surface of the accommodating portion 18.

Referring to FIG. 7, a driving chamber 20 is formed near the rear of the accommodating portion 18 inside the housing 10. The accommodating portion 18 and the driving chamber 20 communicate with each other through the air outlet 18*c*. Further, a filter chamber 22 for filtering air is formed near the rear of the driving chamber 20 inside the housing 10.

Figure 2:
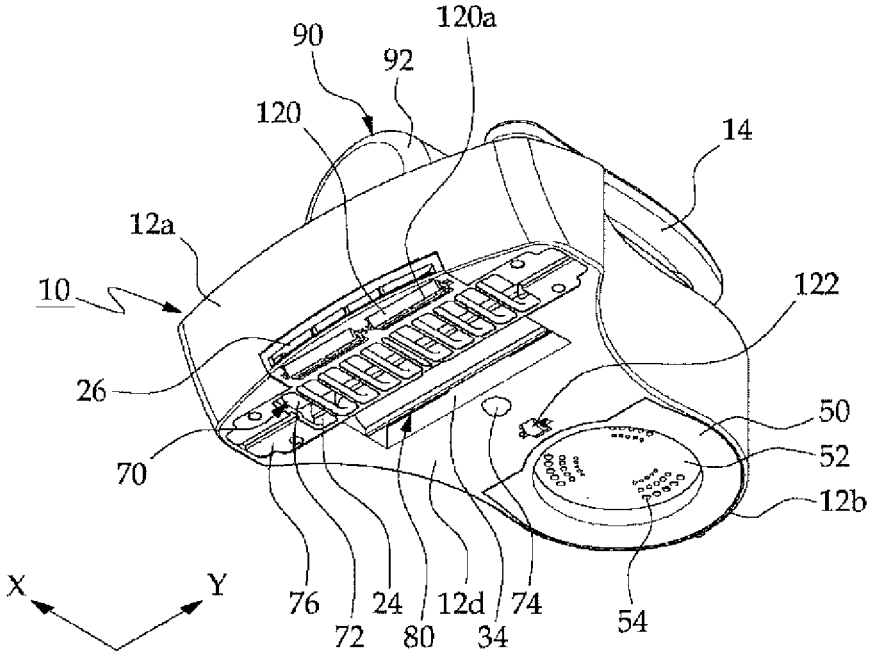
FIG. 2 is a bottom perspective view of the vacuum cleaner according to the present invention.

As shown in FIGS. 2, 7 and 8, a first bottom air inlet 24 is formed in a front portion of the bottom surface 12*d* along the widthwise direction Y of the housing 10 so as to suck up first air from the exterior. A front air inlet 26 is formed beneath the front surface 12*a* so as to communicate with the first bottom air inlet 24. As the first bottom air inlet 24 and the front air inlet 26 communicate with each other, air can be smoothly sucked up. A first recess 28 is sunken in a front portion of the bottom surface 12*d* along the widthwise direction of the housing 10 so as to communicate with the first bottom air inlet 24. The first recess 28 communicates with the accommodating portion 18 through the hole 18*d*.

Figure 5:
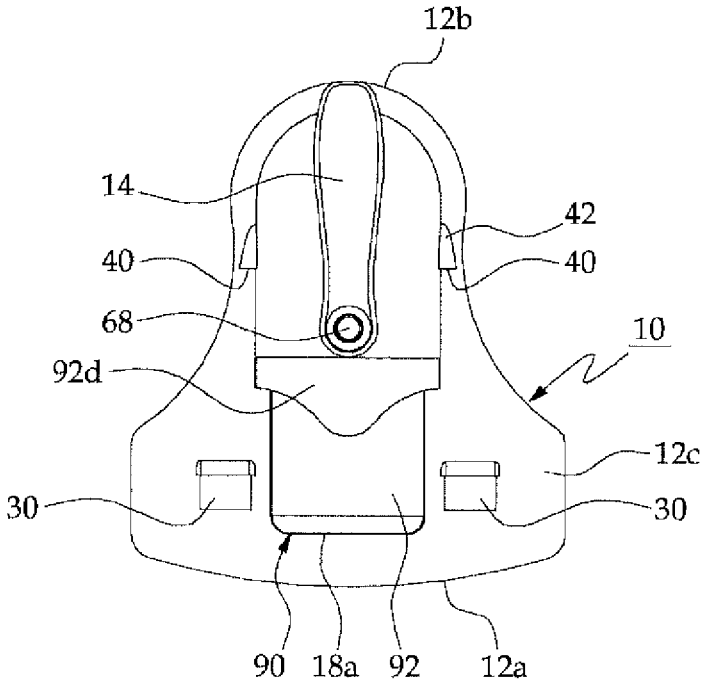
FIG. 5 is a plane view of the vacuum cleaner according to the present invention.
Figure 6:
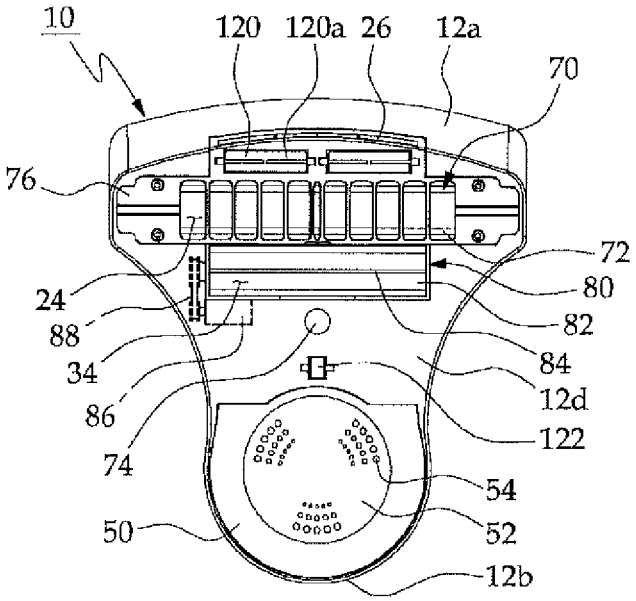
FIG. 6 is a bottom view of the vacuum cleaner according to the present invention.

A headwind inlet 30 is formed in a front portion of the top surface 12*c* so as to suck up second air from the exterior. FIGS. 1 and 5 illustrate an exemplary example where two headwind inlets 30 are formed at opposite sides on the top surface 12*c* and spaced apart from each other along the widthwise direction Y. Alternatively, the number and position of headwind inlet 30 may be properly changed. The first recess 28 and the headwind inlet 30 communicate with each other through an air discharging passage 32 formed inside the housing 10. The air discharging passage 32 communicates with the inside of the first recess 28 facing the first bottom air inlet 24. The second air inhaled into the headwind inlet 30 is discharged into the first recess 28 via the air discharging passage 32.

A second bottom air inlet 34 for sucking up the third air is formed near the first bottom air inlet 24 on the bottom surface 12*d* along the widthwise direction of the housing 10. A second recess 36 is sunken on the bottom surface 12*d* so as to communicate with the second bottom air inlet 34. The first recess 28 and the second recess 36 are arranged near to and in parallel with each other. The first recess 28 and the second recess 36 communicate with each other through an air confluent passage 38 formed along the lengthwise direction of the housing 10. As shown in FIG. 7, flow $F_1$ of the first air and flow $F_2$ of the second air join in the air confluent passage 38 and go toward the second recess 36.

A rear air outlet 40 for discharging air is formed in a back portion of the top surface 12*c* so as to communicate with the filter chamber 22. An air guide 42 is formed over the rear air outlet 40 in order to cover the rear air outlet 40. The air guide 42 guides air discharged through the rear air outlet 40 to flow toward the front of the housing 10. FIG. 5 shows an exemplary example where two rear air outlets 40 are formed in a back portion of the top surface 12*c* and spaced apart from each other along the widthwise direction Y. Alternatively, the number and position of rear air outlets 40 may be changed properly. Further, the rear air outlets 40 may be formed on the back surface 12*b* or lateral surfaces of the housing 10.

Figure 4:
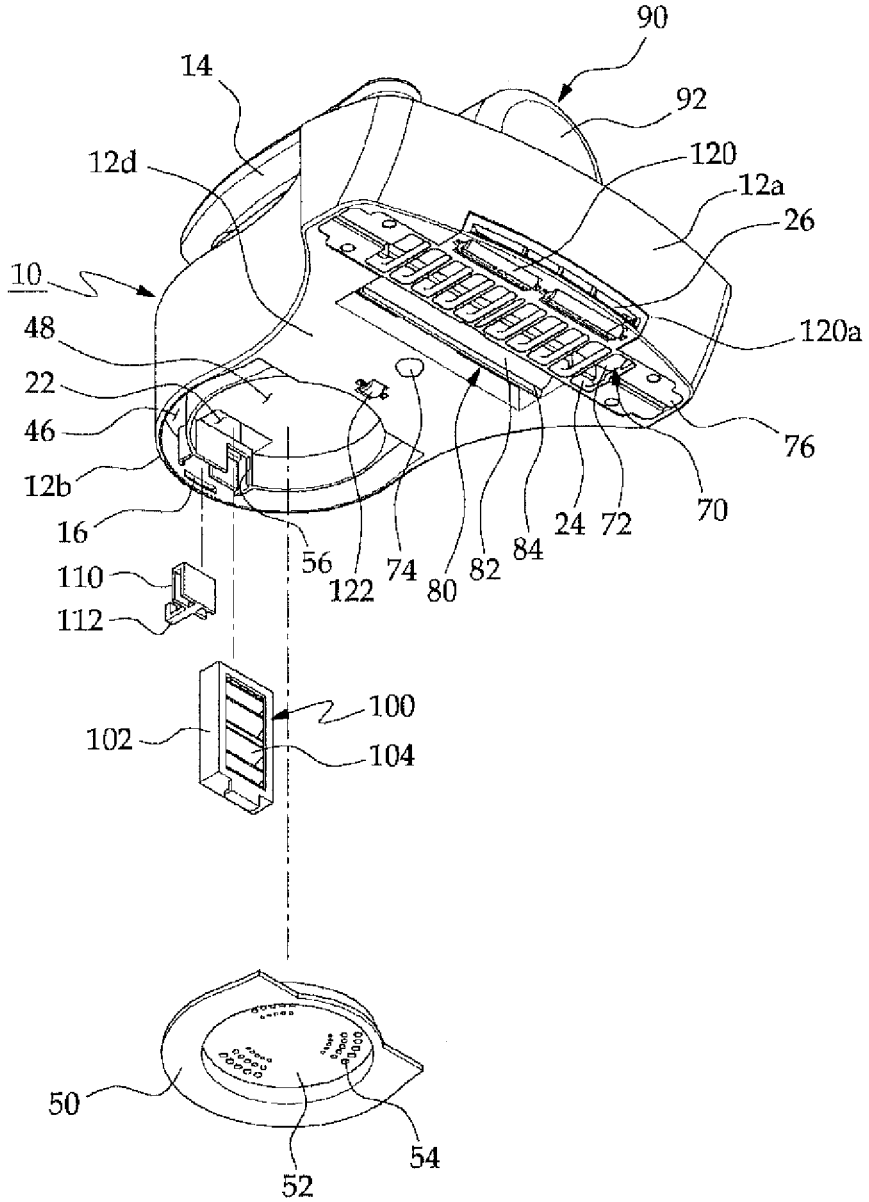
FIG. 4 is a bottom exploded perspective view for showing that a cover plate, a second filter unit and a baffle plate are separated from the vacuum cleaner according to the present invention.

An air passage 44 is formed inside the housing 10 and guides air to flow from the first bottom air inlet 24 of the front to the rear air outlet 40 of the back. The rear air outlet 40 and the air passage 44 communicate with each other through a first branched passage 46 formed inside the housing 10 and branched from the air passage 44. A bottom hot-air discharge chamber 48 is formed in a back portion of the bottom surface 12*d* so as to communicate with the filter chamber 22. FIG. 4 shows an exemplary example where the bottom hot-air discharge chamber 48 is shaped like a circle. Alternatively, the bottom hot-air discharge chamber 48 may have various shapes such as a quadrangle, an ellipse, etc.

A cover plate 50 is mounted in the bottom surface 12*d* so as to cover the bottom hot-air discharge chamber 48. A recess 52 is formed on the cover plate 50. The recess 52 is sunken in the bottom hot-air discharge chamber 48. A plurality of bottom air outlets 54 are formed on a bottom of the recess 52 so as to communicate with the bottom hot-air discharge chamber 48, thereby discharging the hot air. The air passage 44 and the bottom air outlets 54 communicates with each other through a second branched passage 56 formed at one side of the bottom hot-air discharge chamber 48. Alternatively, one or more bottom air outlets may be formed in a back portion of the bottom surface 12*d* so as to communicate with the air passage 44. In this case, the cover plate 50 may be omitted.

Referring to FIG. 7, a vacuum cleaner according to the present invention includes an electric blower fan 60 mounted in the driving chamber 20 and sucking up air. The electric blower fan 60 includes an electric motor 62, and a fan 64 that is rotated by an operation of the electric motor 62. An air guide 66 is placed in the housing 10 and surrounds the fan 64. The air guide 66 guides air flowing from the accommodating portion 18 to the driving chamber 20 along the air passage 44 to pass by the electric motor 62. Heat generated by the operation of the electric motor 62 heats and changes air flowing along the air passage 44 into hot air. As shown in FIGS. 1 and 5, a power switch 68 for controlling the operation of the electric motor 62 is provided in the grip 14. The power switch 68 may be achieved by a push button switch, a slide switch, etc.

Referring to FIGS. 2, 4 and 6 to 8, a vacuum cleaner according to the present invention includes an ultraviolet light source 70 that emits ultraviolet light to the objects to be cleaned 2 in order to sterilize the objects to be cleaned 2. The ultraviolet light source 70 is mounted in the first recess 28. The ultraviolet light source 70 includes an ultraviolet lamp 72 and an ultraviolet light emitting diode (UV LED). The ultraviolet lamp 72 is placed inside the second recess 36 so that the flow $F_1$ of the first air and the flow $F_2$ of the second air can flow toward the air confluent passage 38.

A touch switch 74 for turning on and off the ultraviolet lamp 72 protrudes from the central portion of the bottom surface 12*d*. If the touch switch 74 contacts the objects to be cleaned 2 and outputs an on-signal, the ultraviolet lamp 72 is turned on. If the touch switch 74 comes off the objects to be cleaned 2 and outputs an off-signal, the ultraviolet lamp 72 is turned off. Alternatively, the touch switch 74 may be achieved by a proximity sensor that senses proximity of the objects to be cleaned 2, a pressure sensor that senses contact with the objects to be cleaned 2, etc.

A grill filter 76 is mounted in the first bottom air inlet 24 so as to protect the ultraviolet lamp 72. The grill filter 76 is configured to cover the first bottom air inlet 24 and the front air inlet 26. The grill filter 76 contacts the bedclothes 4 so as to prevent the bedclothes 4 from entering the first bottom air inlet 24 and the front air inlet 26. A light guide 78 is mounted in a hole 18*d*. The light of the ultraviolet lamp 72 is guided by the light guide 78 to illuminate the inside of the accommodating portion 18.

Referring to FIGS. 2, 4 and 6 to 8, the vacuum cleaner according to the present invention includes a duster 80 for dusting foreign materials from the objects to be cleaned 2. The duster 80 is achieved by a cylindrical brush that includes a roller 82 rotatably provided inside the second recess 36, and a plurality of brush wools 84 implanted on an outer surface of the roller 82 and protruding beyond the second bottom air inlet 34 so as to contact the objects to be cleaned 2. The roller 82 is connected to an electric motor 86 and a power train by a belt gearing 88. The power train may be achieved by a gear device. According to some exemplary embodiments, the duster 80 may be achieved by an actuator-based duster that includes an actuator and a hitting unit moving up and down by an operation of the actuator. The actuator-based duster may be mounted in the bottom surface 12*d* of the housing 10 and used together with the cylindrical brush.

Referring to FIGS. 1, 5, 7 and 8, the vacuum cleaner according to the present invention includes a first filter unit 90 detachably mounted in the accommodating portion 18 so as to filter the air. The first filter unit 90 includes a dust box 92, a rotary filter cylinder 94, and a filter element 96.

The dust box 92 is detachably installed in the accommodating portion 18 via the open end 18*a*. The dust box 92 includes a dust chamber 92*a* for collecting dust or the like foreign materials, an air inlet 92*b* connected to the dust chamber 92*a* so as to inhale air, and an air outlet 92*c* for discharging air. The air inlet 92*b* is formed on an outer bottom of the dust box 92 so as to communicate with the air inlet 18*b* of the accommodating portion 18. The air outlet 92*c* is formed on one lateral side of the dust box 92 so as to communicate with the air outlet 18*b* of the accommodating portion 18. A grip 92*d* is mounted in an outer top of the dust box 92. The dust box 92 is made of transparent plastic such as polyethylene, polypropylene, polycarbonate, acryl, etc. so that a user can check the dust box 92 by his/her naked eyes.

The rotary filter cylinder 94 is shaped like a hollow cylinder to have a bore 94*a* for flowing air, and rotatably provided inside the dust chamber 92*a*. The rotary filter cylinder 94 includes a plurality of air inlets 94*b* formed on an outer back thereof along a circumferential direction to communicate with the bore 94*a*, and an air outlet 94*c* opened on a front surface to communicate with the bore 94*a*. The air outlet 94*c* is aligned with the air outlet 18*c* of the accommodating portion 18. An impeller 94*d* is provided at an outer front side of the rotary filter cylinder 94. The impeller 94*d* is arranged above the air inlet 92*b*, and receives a rotary force based on wind power of air inhaled through the air inlet 92*b*. The rotary force of the impeller 94*d* causes the rotary filter cylinder 94 to rotate inside the dust chamber 92*a*. The filter element 96 is shaped like a cylinder and mounted in an outer surface of the rotary filter cylinder 94, thereby covering the air inlets 94*b*. A grill filter 98 is disposed at an air outlet 18*c* of the accommodating portion 18. According to some exemplary embodiments, the first filter unit 90 may be achieved by a dust bag replaceably mounted inside the housing 10 and connected to the air passage 44.

Referring to FIGS. 4, 7, 8, 9, 11 and 13, the vacuum cleaner according to the present invention includes a second filter unit 100 mounted in the filter chamber 22 so as to filter air. The second filter unit 100 includes a filter frame 102 and a filter element 104. The filter frame 102 is detachably mounted in the filter chamber 22. The filter element 104 is mounted in the filter frame 102 so as to filter foreign materials from air passing through the filter chamber 22. The filter element 104 may be achieved by a flexible folded filter, also called a high efficiency particulate air (HEPA) filter, to filter off fine dust.

Referring to FIGS. 4, 7, 8 and 9 to 13, the vacuum cleaner according to the present invention includes a flow direction changer that makes hot air heated by heat generated in the electric blower fan 60 flow toward either of the rear air outlet 40 or the bottom air outlets 54*m* or toward both the rear air outlet 40 and the bottom air outlet 54. The flow direction changer includes the first branched passage 46, the second branched passage 56 and a baffle plate 110. The baffle plate 110 is movably provided in the air passage 44 to selectively open and close the first branched passage 46 and the second branched passage 56. A knob 112 for a user's control is formed at one side of the baffle plate 110 and protrudes outward from the housing 10.

Referring to FIGS. 2, 4 and 6 and 8, a pair of first rollers 120 is rotatably mounted in a front portion of the bottom surface 12*d* along the widthwise direction Y. A plurality of grooves 120*a* is formed along the lengthwise direction of the first rollers 120. A second roller 122 is also rotatably mounted at the central portion of the bottom surface 12*d*. The first and second rollers 120 and 122 contact the objects to be cleaned 2 in order to keep a distance between the objects to be cleaned 2 and the bottom surface 12*d*, and their rolling motion makes the vacuum cleaner smoothly move. Further, the first rollers 120 separate foreign materials from the objects to be cleaned 2 by the grooves 120*a*.

From now, operations of the vacuum cleaner with this configuration according to the present invention will be described.

Referring to FIG. 7, if the electric motor 62 is driven to rotate the fan 64 while the bottom surface 12*d* of the housing 10 is in the proximity of the surface of the objects to be cleaned 2, a force is generated to suck up air. When the suction force is generated, the first air containing dust or the like foreign materials is inhaled into the first recess 28 through the grill filter 76 and the first bottom air inlet 24. The flow $F_1$ of the first air is toward the air confluent passage 38.

After the second air is inhaled into the headwind inlet 30, the second air flows along the air discharging passage 32 and is discharged into the first recess 28. The flow $F_2$ of the second air passes by the ultraviolet lamp 72 and serves as a headwind against the flow $F_1$ of the first air. The flow $F_2$ of the second air prevents the flexible objects to be cleaned 2 such as the bedclothes 4 from being adsorbed to the grill filter 76, thereby improving a cleaning efficiency. The flow $F_1$ of the first air and the flow F2 of the second air join in the air confluent passage 38 and go toward the accommodating portion 18 along the air passage 44 while passing through the second recess 36.

As shown in FIGS. 2, 3, 7 and 8, the ultraviolet lamp 72 operates to emit ultraviolet light. The ultraviolet light is emitted to the objects to be cleaned 2 through the grill filter 76 so as to sterilize the objects to be cleaned 2. The light of the ultraviolet lamp 72 is also guided by the light guide 78 to illuminate the dust box 92 in the accommodating portion 18. Thus, a user can check the amount of foreign materials collected in the transparent dust box 92 with his/her naked eyes based on the light of the ultraviolet lamp 72. Further, a user can grips the grip 92*d* and then separate the dust box 92 from the accommodating portion 18.

To clean the objects to be cleaned 2, a user moves the vacuum cleaner along the surface of the objects to be cleaned 2. If the electric motor 86 is driven to rotate the roller 82, the brush wools 84 brushes dust, harmful insects, etc. off the surface of the objects to be cleaned 2 while sweeping the objects to be cleaned 2 by the rotation of the roller 82. The dust separated from the objects to be cleaned 2 is inhaled together with the third air into the second recess 36 through the second bottom air inlet 34, and flows to the accommodating portion 18 along the air passage 44.

In succession, air, i.e. the first to third air is inhaled into the dust chamber 92*a* through the air inlet 18*b* of the accommodating portion 18 and the air inlet 92*b* of the dust box 92. The wind force of the air inhaled into the dust chamber 92*a* makes the impeller 94*d* rotate, and the rotation of the impeller 94*d* causes the rotary filter cylinder 94 to rotate. Air is primarily filtered by the filter element 96 while forming swirl flow around the rotary filter cylinder 94. The rotation of the rotary filter cylinder 94 and the formation of the swirl flow prevent the dust in air from being adhered to the outer surface of the filter element 96, and thus prevent the filter element 96 from clogging. The dust filtered by the filter element 96 is collected in the dust chamber 92*a*.

Air is sent to the driving chamber 20 via the filter element 96, the bore 94*a* and the air outlet 94*c* of the rotary filter cylinder 94, the air outlet 18*c* of the accommodating portion 18, and the air guide 66. Air is heated and changed into hot air by heat of the electric motor 62 while passing by the electric blower fan 60. The hot air flows along the air passage 34 and enters the filter chamber 22, and is then secondarily filtered by the filter element 104.

In the vacuum cleaner according to the present invention, a user controls the baffle plate 110 to selectively change the flow direction of the hot air so that the hot air passed through the filter element 104 can be discharged through the rear air outlet 40 and the bottom air outlets 54. Further, a user employs a knob 112 to rotate the baffle plate 110 so that the first branched passage 46 and the second branched passage 56 can be selectively opened and closed.

Figure 9:
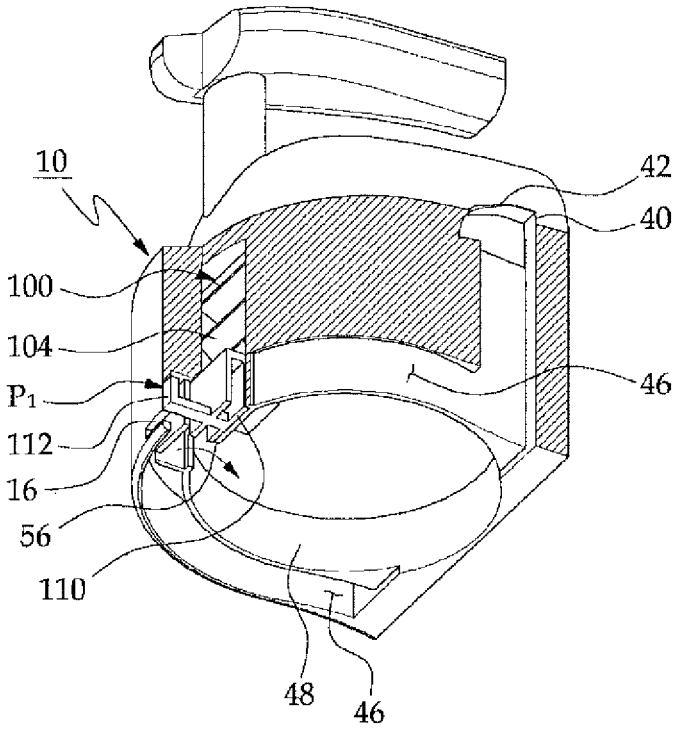
FIG. 9 is a partially cut-open perspective view for explaining that hot air is discharged through a bottom air outlet in the vacuum cleaner according to the present invention.
Figure 10:
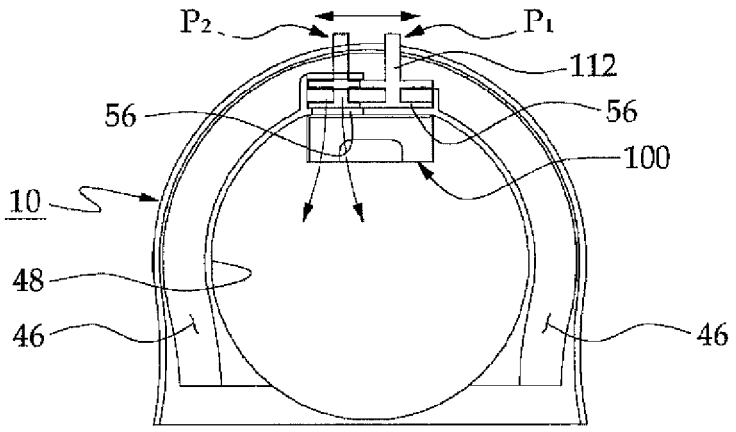
FIG. 10 is a partial bottom view for explaining that the hot air is discharged through the bottom air outlet in the vacuum cleaner according to the present invention.
Figure 11:
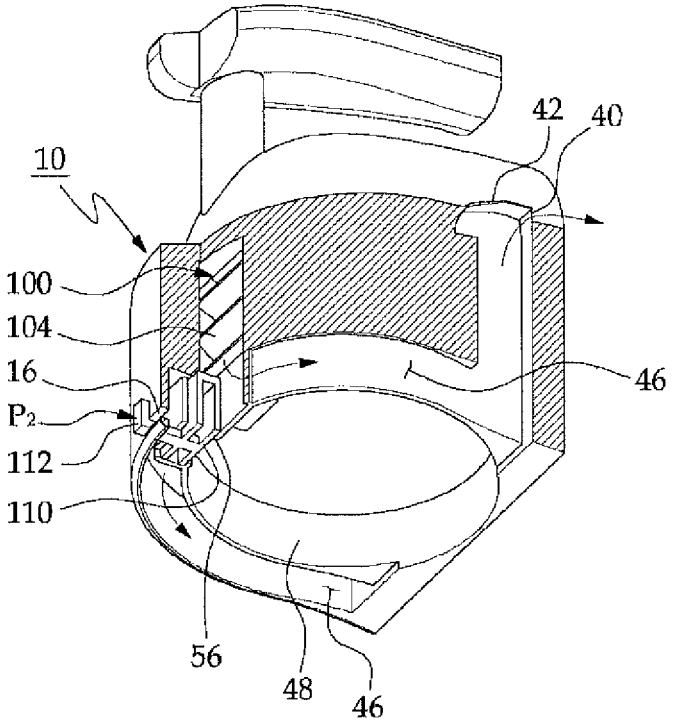
FIG. 11 is a partially cut-open perspective view for explaining that the hot air is discharged through the rear air outlet in the vacuum cleaner according to the present invention.
Figure 12:
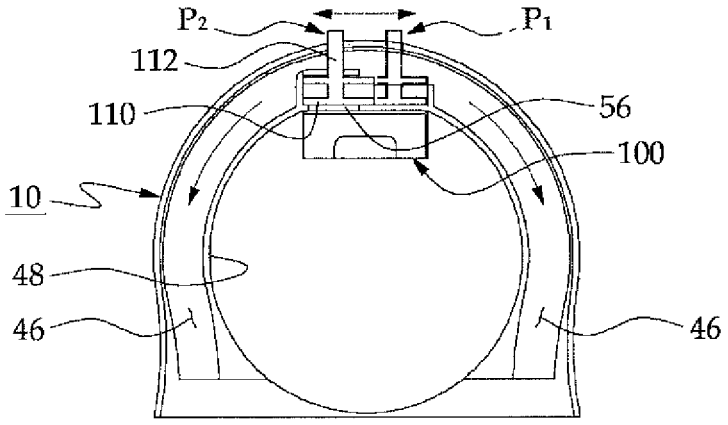
FIG. 12 is a partial bottom view for explaining that the hot air is discharged through the rear air outlet in the vacuum cleaner according to the present invention.
Figure 13:
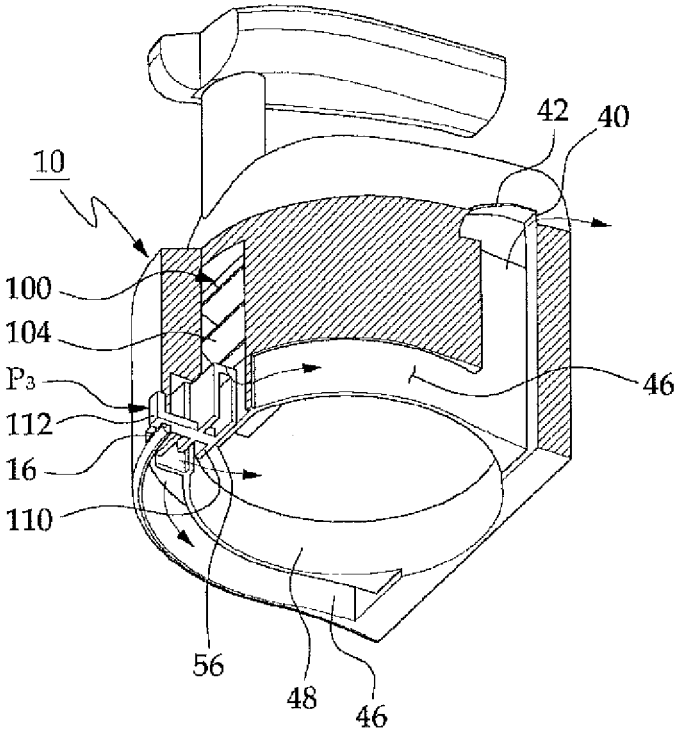
FIG. 13 is a partially cut-open perspective view for explaining that the hot air is discharged through the rear air outlet and the bottom air outlet in the vacuum cleaner according to the present invention.
Figure 14:
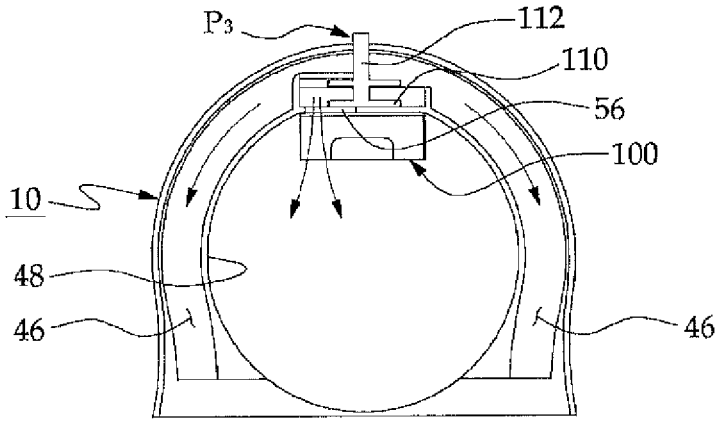
FIG. 14 is a partial bottom view for explaining that the hot air is discharged through the rear air outlet and the bottom air outlet in the vacuum cleaner according to the present invention.

As shown in FIGS. 4, 9 and 10, the baffle plate 110 closes the first branched passage 46 and opens the second branched passage 56 at a first position P1. The hot air is blown to the bedclothes 4 via the second branched passage 56 and the bottom air outlet 54 so as to dry the bedclothes 4. As shown in FIGS. 5, 11 and 12, the baffle plate 110 opens the first branched passage 46 and closes the second branched passage 56 at a second position P2. In this position, the hot air is discharged out of the housing 20 through only the rear air outlet 40, and the bottom air outlets 54 discharge no air.

As shown in FIGS. 4, 5, 13 and 14, the baffle plate 110 half opens the first branched passage 46 and the second branched passage 56 at a third position P3 between the first position P1 and the second position P2. The hot air is partially blown to the bedclothes 4 via the second branched passage 56 and the bottom air outlet 54, thereby drying the bedclothes 4. The rest of hot air is discharged out of the housing 20 via the first branched passage 46 and the rear air outlet 40. Thus, it is easy and convenient for a user to control the direction and amount of discharging the hot air using the baffle plate 110 in consideration of the state of the objects to be cleaned 2, thereby improving cleaning and drying efficiencies.

Figure 15:
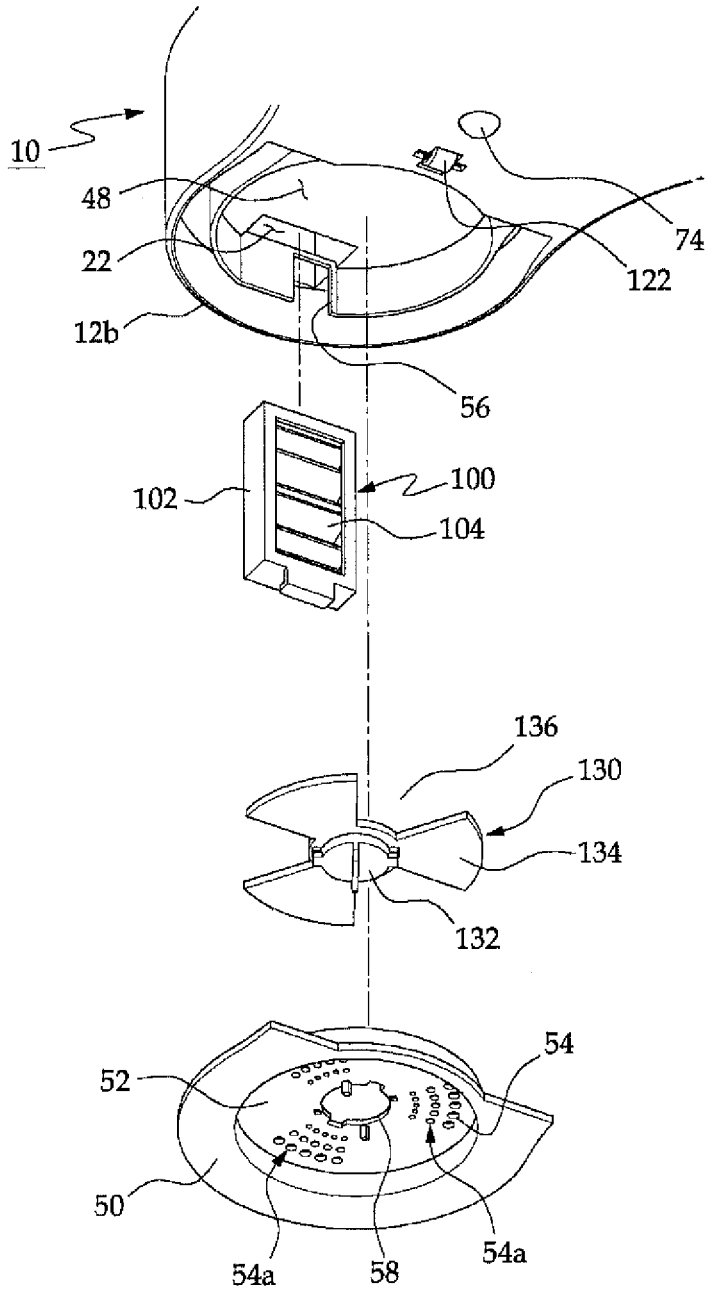
FIG. 15 is an exploded perspective view for showing that a cover plate and a baffle plate of another embodiment are separated from the vacuum cleaner according to the present invention.
Figure 16:
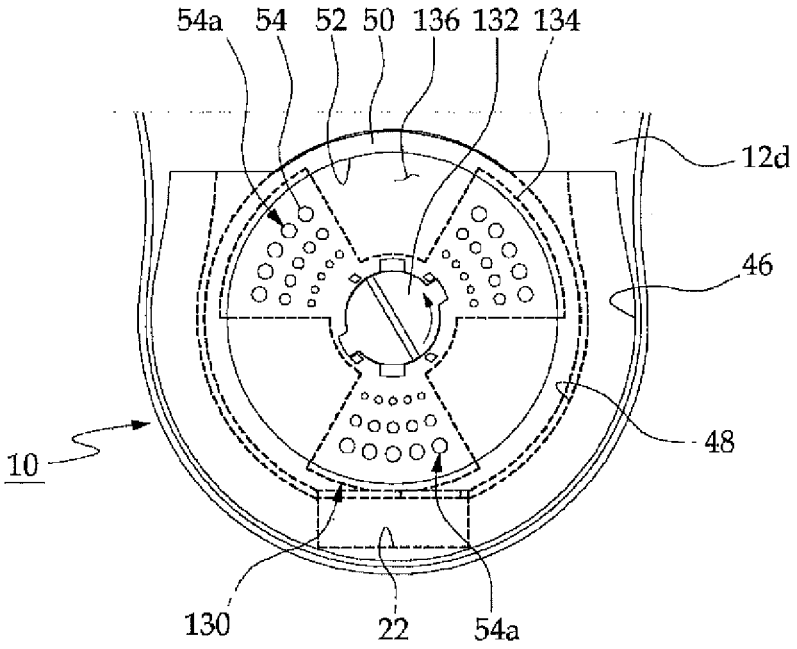
FIGS. 16 and 17 are bottom views for explaining operations of the cover plate and the baffle plate of another embodiment in the vacuum cleaner according to the present invention.
Figure 17:
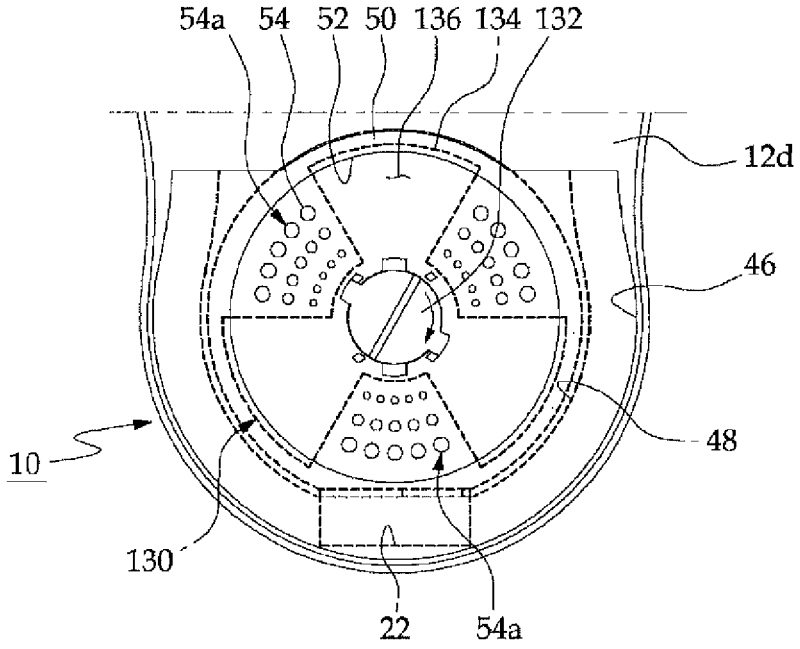

FIGS. 15 to 17 illustrate alternative embodiments of a flow direction changer in the vacuum cleaner according to the present invention. Referring to FIGS. 15 to 17, the flow direction changer of this embodiment includes the first branched passage 46, the second branched passage 56 and a baffle plate 130. The baffle plate 130 is mounted in a hot air discharge chamber 48 so as to open and close the bottom air outlets 54 of the cover plate 50. The bottom air outlets 54 includes a plurality of bottom air outlet groups 54*a* arranged at regular intervals and grouped in a circumferential direction of the cover plate 50. A hole 58 is formed at the central portion of the cover plate 50. A knob 132 protrudes from a bottom central portion of the baffle plate 130. The knob 132 is fitted to the hole 58 and protrudes in the recess 52. The baffle plate 130 includes a plurality of shutter portions 134 arranged at regular intervals along a circumferential direction to open and close the bottom air outlet groups 54*a*. A plurality of hot air discharging spaces 136 is formed in between the shutter portions 134.

As shown in FIG. 16, if the shutter portions 134 shut the bottom air outlet groups 54*a*, the hot air is not discharged through the bottom air outlets 54. At this time, the hot air is discharged out of the housing 10 through the first branched passage 46 and the rear air outlet 40. As shown in FIG. 17, if the baffle plate 130 is rotated by control of the knob 132 and thus the shutter portions 132 are arranged in between the bottom air outlet groups 54*a*, the hot air discharging spaces 136 are aligned with the bottom air outlets 54 so that the bottom air outlets 54 can be open. The hot air passed through the second branched passage 56 is blown to the objects to be cleaned 2 through the open bottom air outlets 54.

Although some embodiments have been provided to illustrate the invention, it should be understood that these embodiments are given by way of illustration only, and that various modifications, variations, and alterations can be made without departing from the spirit and scope of the present invention. Therefore, the scope of the present invention should be limited only by the accompanying claims and equivalents thereof.

The invention claimed is:

1. A vacuum cleaner comprising a first bottom air inlet, a rear air outlet, a housing having an air passage for guiding a first air to flow from the first bottom air inlet to the rear air outlet, and an electric blower fan mounted in the air passage and generating a force for sucking up the first air, the housing comprising a headwind inlet that inhales second air from an exterior and guides flow of the inhaled second air as a headwind against the flow of the first air so as to prevent adhesion of objects to be cleaned, and a bottom air outlet formed on a bottom surface of the housing to discharge hot air heated by heat of the electric blower fan while passing by the electric blower fan, the vacuum cleaner comprising a flow direction changer mounted on the housing and changing a flow direction of the hot air to the rear air outlet and/or the bottom air outlet.

2. The vacuum cleaner according to claim 1, wherein the flow direction changer comprises a first branched passage formed inside the housing and connecting the air passage and the rear air outlet;

a second branched passage formed inside the housing and connecting the air passage and the bottom air outlet; and a baffle plate mounted inside the housing to open and close the first branched passage and/or the second branched passage.

3. The vacuum cleaner according to claim 1, wherein the flow direction changer comprises a first branched passage formed inside the housing and connecting the air passage and the rear air outlet;

a second branched passage formed inside the housing and connecting the air passage and the bottom air outlet; and a baffle plate rotatably mounted inside the housing to open and close the bottom air outlet.

4. The vacuum cleaner according to claim 1, wherein an air discharging passage is formed inside the housing to connect the first bottom air inlet and the front air inlet, a first recess is formed in a front portion of the bottom surface of the housing so that the first bottom air inlet and the air discharging passage can communicate with each other, and an ultraviolet light source is provided inside the first recess to emit ultraviolet light for sterilizing the objects to be cleaned.

5. The vacuum cleaner according to claim 4, wherein a second bottom air inlet is formed near the first bottom air inlet on the bottom surface of the housing to suck up third air, a second recess is formed on the bottom surface to communicate with the second bottom air inlet, and the first recess and the second recess communicate with each other through an air confluent passage in which flow of the first air and flow of the second air join.

6. The vacuum cleaner according to claim 4, further comprising a duster mounted in the second recess to dust foreign materials from the objects to be cleaned;

a pair of first rollers mounted in a front portion of the bottom surface of the housing along a widthwise direction of the housing so as to roll while being in contact with the objects to be cleaned, and formed with a plurality of grooves on an outer surface thereof to clear out foreign materials from the objects to be cleaned; and a second roller mounted in a central portion of the bottom surface of the housing so as to roll while being in contact with the objects to be cleaned.

7. The vacuum cleaner according to claim 4, wherein a hot air discharge chamber is formed inside the housing to communicate with the second branched passage, a cover plate is mounted on the bottom surface of the housing to cover the hot air discharge chamber, a recess is formed on the cover plate to be sunken in the hot air discharge chamber, and the bottom air outlet is formed on a bottom of the recess.

8. The vacuum cleaner according to claim 4, wherein an accommodating portion is formed on an outer surface of the housing so as to communicate with the air passage, a filter chamber is formed inside the housing so as to communicate with a driving chamber, a first filter unit for filtering air is detachably mounted in the accommodating portion, and a second filter unit for filtering air is detachably mounted in the filter chamber.

9. The vacuum cleaner according to claim 8, wherein the first filter unit comprises a dust box detachably installed in the accommodating portion, the dust box having a dust chamber communicating with the air passage;

a rotary filter cylinder installed in the dust chamber so that air inhaled into the dust chamber can swirl, formed with an impeller on an outer surface thereof to rotate by flow of air inhaled into the dust chamber, and comprising a bore, an air inlet and an air outlet to communicate with the air passage; and a filter element for filtering air is disposed at the air inlet of the rotary filter cylinder.

10. The vacuum cleaner according to claim 9, wherein the dust box is made of transparent plastic, and a light guide is mounted in a bottom of the accommodating portion so as to guide light from the ultraviolet light source toward the dust box.

* * * * *